US010461508B2

(12) United States Patent
Bohne et al.

(10) Patent No.: US 10,461,508 B2
(45) Date of Patent: Oct. 29, 2019

(54) PROTECTIVE SLEEVE FOR A CORONA IGNITOR IN A SPARK PLUG SHAFT OF AN ENGINE

(71) Applicant: BorgWarner Ludwigsburg GmbH, Ludwigsburg (DE)

(72) Inventors: Steffen Bohne, Ludwigsburg (DE); Nicolaus Wulff, Stuttgart (DE); Peter Schlöffel, Asperg (DE)

(73) Assignee: BORGWARNER LUDWIGSBURG GMBH, Ludwigsburg (DE)

( * ) Notice: Subject to any disclaimer, the term of this patent is extended or adjusted under 35 U.S.C. 154(b) by 0 days.

(21) Appl. No.: 15/654,253

(22) Filed: Jul. 19, 2017

(65) Prior Publication Data

US 2018/0026427 A1 Jan. 25, 2018

(30) Foreign Application Priority Data

Jul. 22, 2016 (DE) ..... 10 2016 113 570

(51) Int. Cl.

| | |
|---|---|
| ***H01T 13/06*** | (2006.01) |
| ***F02P 13/00*** | (2006.01) |
| ***H01T 13/08*** | (2006.01) |
| ***H01T 13/50*** | (2006.01) |
| ***H01T 19/00*** | (2006.01) |

(52) U.S. Cl.

CPC ..... *H01T 13/06* (2013.01); *F02P 13/00* (2013.01); *H01T 13/08* (2013.01); *H01T 13/50* (2013.01); *H01T 19/00* (2013.01)

(58) Field of Classification Search

CPC ..... H01T 13/06; H01T 13/08; H01T 13/50; H01T 19/00; F02P 13/00

USPC ..... 123/169 R, 143 B; 29/592.1

See application file for complete search history.

(56) References Cited

U.S. PATENT DOCUMENTS

| | | | | |
|---|---|---|---|---|
| 4,475,030 | A * | 10/1984 | Bailey | F23Q 7/001 123/145 A |
| 5,799,633 | A * | 9/1998 | Miller | H01T 13/06 123/143 C |
| 5,944,002 | A * | 8/1999 | Tracy | H01T 13/06 123/143 C |
| 9,464,618 | B2 | 10/2016 | Stifel et al. | |
| 2002/0157629 | A1* | 10/2002 | Inagaki | F02F 1/242 123/169 PA |
| 2002/0166528 | A1* | 11/2002 | Holmes | H01T 13/04 123/169 PA |
| 2004/0250797 | A1* | 12/2004 | Shetley | F02D 19/066 123/525 |
| 2014/0137845 | A1* | 5/2014 | Achtstatter | H01T 13/34 123/634 |

(Continued)

FOREIGN PATENT DOCUMENTS

| | | | | |
|---|---|---|---|---|
| DE | 4314184 | A1 * | 11/1994 | F02F 1/242 |
| DE | 10 2010 039 597 | A1 | 2/2012 | |

(Continued)

*Primary Examiner* — Mahmoud Gimie

(74) *Attorney, Agent, or Firm* — Bose McKinney & Evans LLP

(57) ABSTRACT

This disclosure pertains to a protective sleeve for protecting a corona igniter in a spark plug shaft of an internal combustion engine, wherein the protective sleeve comprises a collar for sitting on a rim of a spark plug shaft opening and a tubular section for being inserted into the spark plug shaft and for receiving the corona igniter.

17 Claims, 1 Drawing Sheet

(56) References Cited

U.S. PATENT DOCUMENTS

2018/0026427 A1* 1/2018 Bohne ..... H01T 13/06

FOREIGN PATENT DOCUMENTS

| | | | | | |
|---|---|---|---|---|---|
| DE | 10 2012 110 362 | B4 | | 10/2015 | |
| DE | 10 2014 014 357 | A1 | | 3/2016 | |
| DE | 10 2016 004 968 | A1 | | 9/2016 | |
| FR | 2450520 | A | * | 10/1980 | ..... H01T 13/08 |
| JP | 10125442 | A | * | 5/1998 | ..... H01T 13/06 |

* cited by examiner

PROTECTIVE SLEEVE FOR A CORONA IGNITOR IN A SPARK PLUG SHAFT OF AN ENGINE

RELATED APPLICATIONS

This application claims priority to DE 10 2016 113 570.4, filed Jul. 22, 2016, the entire disclosure of which is hereby incorporated herein by reference in its entirety.

BACKGROUND

The invention relates to a protective sleeve for a corona igniter in a spark plug shaft of an internal combustion engine.

Corona igniters are known, for example, from U.S. Publication No. 2014/116370 A1. Corona igniters cause an ignition in the combustion chamber of an engine by means of a corona discharge and therefore represent an alternative to conventional spark plugs, which cause an ignition by means of an arc discharge.

In comparison with spark plugs, corona igniters make it possible to realize a more precise control of the ignition point, as well as a lower fuel consumption and reduced emissions, but corona igniters are mechanically less robust than spark plugs. For example, corona igniters typically have sensitive ignition tips that can be damaged during the installation into the spark plug shaft of an engine. In addition, vibrations occurring during the operation of the engine can lead to mechanical stresses and to premature failure of a corona igniter.

SUMMARY

This disclosure shows how the service life of a corona igniter can be extended and a premature failure thereof be prevented.

The protective sleeve is configured to be inserted into the spark plug shaft of an internal combustion engine. The protective sleeve comprises a collar that is seated on the edge of the spark plug shaft opening and therefore has a greater width than the maximum diameter of the spark plug shaft. The protective sleeve also comprises a tubular section adjacent to the collar and designed for surrounding a corona igniter inside the spark plug shaft. The protective sleeve guides the corona igniter during its insertion into the spark plug shaft and thereby reduces the risk of damaging sensitive ignition tips during the installation of a corona igniter. In addition, the protective sleeve can dampen vibrations of the corona igniter that are generated by the engine.

When the corona igniter is inserted into the spark plug shaft and screwed to the cylinder head, the collar of the protective sleeve is pressed against the rim of the spark plug shaft opening by the corona igniter. The protective sleeve is therefore clamped between the engine block and the corona igniter and can dampen engine-related vibrations of the corona igniter.

According to an advantageous refinement of this disclosure, the tubular section comprises multiple cylindrical sections with different diameters, for example two cylindrical sections with different diameters. A transition section is respectively arranged between two such cylindrical sections and connects the two cylindrical sections to one another. For example, the transition section may have a conical shape.

According to another advantageous refinement of this disclosure, the underside of the collar carries a seal or gasket that rests on the rim of the spark plug shaft opening after the insertion of the protective sleeve into the spark plug shaft. The seal may be realized, for example, in the form of an O-ring or a sealing lip and can additionally improve the vibration-damping effect of the protective sleeve. The seal or gasket may be seated, for example, in an annular groove on the underside of the collar.

According to another advantageous refinement of this disclosure, it is proposed that the collar carries a seal or gasket for sealing an annular gap between the protective sleeve and the corona igniter, for example on its upper side or in its interior. This seal or gasket may be seated, for example, on an annular shoulder of the collar. The corona igniter presses against this seal or gasket when it is inserted into the protective sleeve and screwed to the engine. In this way, improved damping of engine-related vibrations is achieved. This seal or gasket may be realized, for example, in the form of an O-ring or a sealing lip.

The collar preferably features a ventilation bore. Positive or negative pressure in the spark plug shaft can be compensated by means of this ventilation bore.

According to another advantageous refinement of this disclosure, the protective sleeve, particularly the collar and the tubular section, is made of plastic, e.g., polyamide. The collar and the tubular section are preferably realized in one piece, for example, in the form of an injection-molded part. In this way, the protective sleeve has an advantageously low weight and can be cost-efficiently manufactured.

The protective sleeve may be dimensioned in such a way that a continuous annular gap is formed between the protective sleeve and the wall of the spark plug shaft. Furthermore, a continuous annular gap is preferably also formed between the corona igniter and the tubular section. In this case, the engine, the protective sleeve and the corona igniter form a system, the components of which are adapted to one another.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
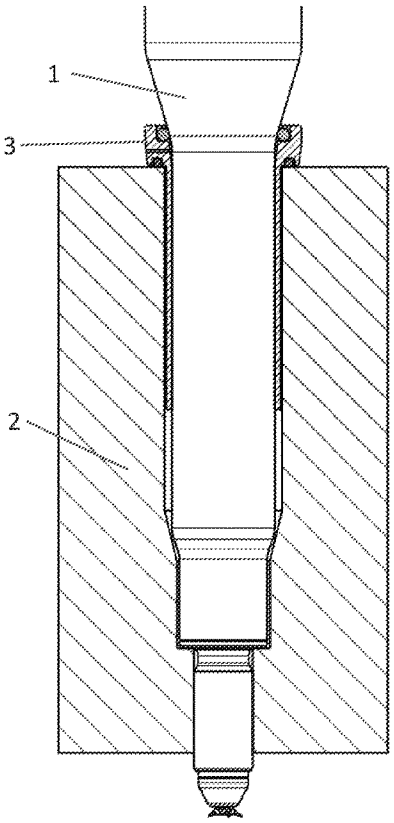
FIG. 1 shows a schematic representation of a corona igniter with a protective sleeve in a spark plug shaft of an engine.
Figure 2:
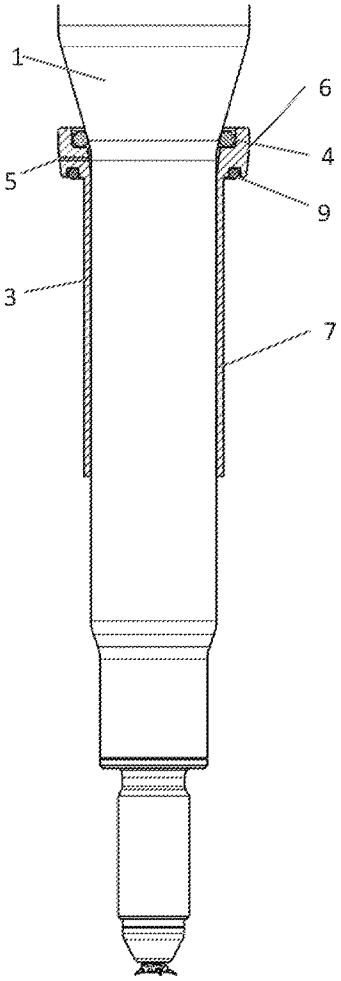
FIG. 2 shows a schematic detail of a corona igniter with a protective sleeve.
Figure 3:
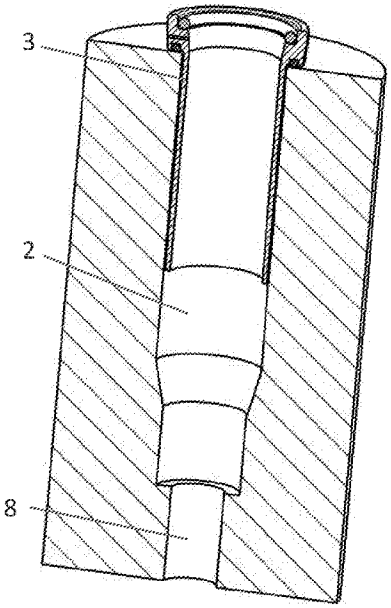
FIG. 3 shows a partially sectioned representation of a protective sleeve in a spark plug shaft of an engine.
Figure 4:
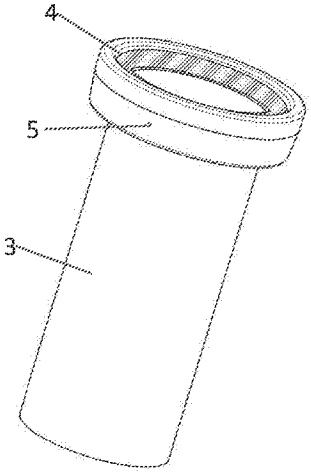
FIG. 4 shows a detail of the protective sleeve.

FIG. 1 schematically shows a corona igniter 1 with a protective sleeve 3 in a spark plug shaft of an internal combustion engine 2. Therein the protective sleeve is shown in a sectional view. FIG. 2 shows an upper part of the corona igniter 1 and the sectioned protective sleeve 3, i.e., the part that is respectively located distant from the combustion chamber. FIG. 3 shows a partially sectioned view of the protective sleeve 3 in the spark plug shaft of the internal combustion engine 2, however, without the corona igniter. FIG. 4 shows the upper part of the protective sleeve 3 in the form of a perspective representation.

The protective sleeve 3 comprises a collar 6 for being supported on the edge of the spark plug shaft opening and a tubular section 7 for being inserted into the spark plug shaft of the internal combustion engine 2. In the installed state, the collar 6 is located outside the spark plug shaft whereas the tubular section 7 surrounds the corona igniter within the spark plug shaft.

The spark plug shaft of the engine 3 comprises different sections with different widths. These sections comprise a threaded section 8, into which the corona igniter 1 is screwed, as well as a lower and an upper cylindrical section with different diameters, which may be connected by a conical transition section. The tubular section 7 of the protective sleeve 3 is located in the upper and the lower cylindrical section of the spark plug shaft. The tubular section 7 of the protective sleeve 3 therefore has two cylindrical sections, wherein these cylindrical sections are connected by a transition section that, for example, may have a conical shape.

The underside of the collar 6 of the protective sleeve 3 may carry a seal 9 or gasket, for example an O-ring or a sealing lip. In the installed state, this seal 9 or gasket rests against the edge of the spark plug shaft opening and seals a gap between the collar 6 and the edge of the spark plug shaft opening. The seal 9 or gasket may be seated, for example, in an annular groove on the underside of the collar 6.

The collar 6 may carry a seal 4 for sealing an annular gap between the protective sleeve 3 and the corona igniter 1, for example on its upper side. The seal 4 may be realized, for example, in the form of an O-ring or a sealing lip. The collar 6 may feature an annular shoulder, on which the seal 4 is seated.

The collar 6 may feature a ventilation bore 5 in order to allow a pressure compensation between gas in the spark plug shaft and the surroundings as heating or cooling occurs.

The protective sleeve 3 may be made of plastic and realized, for example, in the form of an injection-molded part. The plastic may be a glass fiber reinforced plastic, e.g., a glass fiber reinforced polyamide.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

LIST OF REFERENCE SYMBOLS

1 Corona igniter
2 Internal combustion engine
3 Protective sleeve
4 Seal
5 Ventilation bore
6 Collar
7 Tubular section
8 Threaded section
9 Seal

What is claimed is:

1. A protective sleeve for protecting a corona igniter that has threads that secure the igniter in a spark plug shaft of an internal combustion engine, the protective sleeve comprising:

a collar configured to be seated on a rim of a spark plug shaft opening, wherein the collar carries a seal for sealing an annular gap between the protective sleeve and the corona igniter; and a tubular section configured for insertion into the spark plug shaft and for receiving the corona igniter.

2. The protective sleeve according to claim 1, wherein the tubular section comprises two cylindrical sections that border on a transition section.

3. The protective sleeve according to claim 2, wherein the transition section is conical.

4. The protective sleeve according to claim 1, wherein the seal is an O-ring.

5. The protective sleeve according to claim 1, wherein the collar has an annular shoulder on which the seal is seated.

6. The protective sleeve of claim 1 wherein the collar has a greater diameter than a maximum diameter of the spark plug shaft opening and a second seal is disposed on an underside of the collar, the second seal being disposed radially outwardly and encircling the spark plug shaft opening to thereby provide a seal between the underside of the collar and the internal combustion engine.

7. The protective sleeve according to claim 1, wherein the tubular section and the collar are made of glass fiber reinforced plastic.

8. The protective sleeve according to claim 1, wherein the collar has a ventilation bore.

9. A protective sleeve for protecting a corona igniter in a spark plug shaft of an internal combustion engine, the protective sleeve comprising:

a collar configured to be seated on a rim of a spark plug shaft opening, wherein the collar carries a first seal for sealing an annular gap between the protective sleeve and the corona igniter;

a second seal positioned on the underside of the collar and resting against the edge of the spark plug shaft opening; and a tubular section configured for insertion into the spark plug shaft and for receiving the corona igniter;

wherein the sleeve is formed of plastic.

10. The protective sleeve of claim 9, wherein the sleeve is formed from a glass fiber reinforced plastic.

11. A protective sleeve for protecting a corona igniter in a spark plug shaft of an internal combustion engine, the protective sleeve comprising:

a collar configured to be seated on a rim of a spark plug shaft opening, wherein the collar carries a seal for sealing an annular gap between the protective sleeve and the corona igniter; and a tubular section configured for insertion into the spark plug shaft and for receiving the corona igniter;

wherein the sleeve is non-threaded and is configured such that the collar is clamped between the motor block and the corona igniter.

12. The protective sleeve of claim, 11 wherein the tubular section has two cylindrical sections having different diameters and the diameter of the cylindrical section closest to the tip of the corona igniter is smaller and wherein the two cylindrical sections are connected by a transition section having a conical shape.

13. The protective sleeve of claim 11 wherein the collar has a greater diameter than a maximum diameter of the spark plug shaft opening and threaded engagement of the corona igniter with the motor block biases the corona igniter against the collar to thereby clamp the collar between the motor block and the corona igniter.

14. The protective sleeve of claim 13 wherein a second seal is disposed on an underside of the collar, the second seal being disposed radially outwardly and encircling the spark plug shaft opening to thereby provide a seal between the underside of the collar and the motor block.

15. The protective sleeve of claim 14 wherein the collar has an annular shoulder on which the seal for sealing the annular gap between the protective sleeve and the corona igniter is disposed.

16. The protective sleeve according to claim 6, wherein the underside of the collar has an annular groove in which the second seal is seated.

17. The protective sleeve of claim 9 wherein the collar has a greater diameter than a maximum diameter of the spark plug shaft opening and the second seal is disposed radially outwardly and encircling the spark plug shaft opening to thereby provide a seal between the underside of the collar and the internal combustion engine.

* * * * *